US007255058B2

(12) United States Patent
Forbes et al.

(10) Patent No.: US 7,255,058 B2
(45) **Date of Patent: *Aug. 14, 2007**

(54) HATCH ASSEMBLY WITH CONTIGUOUS SEATING AREA

(75) Inventors: Evan D. Forbes, Carterville, IL (US); Karlis Matvejs, Marion, IL (US); Kevin J. Reim, Marion, IL (US)

(73) Assignee: Crownline Boats, Inc., West Frankfort, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/219,428

(22) Filed: Sep. 2, 2005

(65) Prior Publication Data

US 2006/0048694 A1 Mar. 9, 2006

Related U.S. Application Data

(63) Continuation-in-part of application No. 11/028,807, filed on Jan. 4, 2005, now Pat. No. 7,000,557.

(60) Provisional application No. 60/607,181, filed on Sep. 3, 2004.

(51) Int. Cl.
*B63B 17/00* (2006.01)

(52) U.S. Cl. ..... 114/363

(58) Field of Classification Search ..... 114/363
See application file for complete search history.

(56) References Cited

U.S. PATENT DOCUMENTS

| | | | | |
|---|---|---|---|---|
| 4,854,261 | A | 8/1989 | Goldsmith | |
| 5,943,979 | A * | 8/1999 | Hattori | 114/362 |
| 6,553,928 | B2 | 4/2003 | Yamada et al. | |
| 2003/0183150 | A1 * | 10/2003 | Eck et al. | 114/363 |

* cited by examiner

*Primary Examiner*—Stephen Avila
(74) *Attorney, Agent, or Firm*—Polster, Lieder, Woodruff & Lucchesi, LC

(57) ABSTRACT

A hatch assembly for a boat including a contiguous seating area across a stern of the boat. The contiguous seating area includes a main portion and at least one removable portion that can be removed to provide access to an entryway to a deck of the boat. The boat also includes a base pivotally attached to a boat deck, whereby the base can pivot between an open position and closed position to provide access to a power source within a boat hull. The base defines a storage bin with a compartment for storage. A lid pivotally attaches to the base, whereby the lid can pivot from an open position to a closed position to provide access to the storage bin. A seat attaches to the lid and is supported by the base. A backrest pivotally attaches to the base and pivots between a sitting position and a reclining position.

15 Claims, 12 Drawing Sheets

HATCH ASSEMBLY WITH CONTIGUOUS SEATING AREA

CROSS-REFERENCE TO RELATED APPLICATIONS

This application is a continuation-in-part of U.S. Pat. No. 7,000,557 filed Jan. 4, 2005 from which priority is claimed, and is hereby incorporated by reference and is related to U.S. Provisional Patent Application No. 60/607,181 filed Sep. 3, 2004 from which priority is claimed, and is hereby incorporated by reference, and is related to U.S. Provisional Patent Application No. 60/651,194 filed Feb. 9, 2005 from which priority is claimed, and is hereby incorporated by reference.

STATEMENT REGARDING FEDERALLY SPONSORED RESEARCH

Not Applicable.

BACKGROUND OF THE INVENTION

This invention relates in general to boats and boat decks, and more particularly, to boat deck hatches. Most modern boats include numerous conveniences that make boating a pleasurable experience. Among these conveniences are flexible seating arrangements, large storage bins, and various accessories, such as tables. However, due to the limited space available on boats, including these conveniences can take away valuable deck space from other more necessary boat components, such as a boat hatch that allows access to an inboard motor. Therefore, it is important to configure all boating components, necessary and convenient, in a configuration that maximizes deck space.

SUMMARY OF THE INVENTION

Briefly stated, one aspect of the invention is a boat having a contiguous seating area across a stern of the boat. The contiguous seating area includes a main portion and at least one removable portion that can be removed to provide access to an entryway to a deck of the boat.

In another aspect, a contiguous seating area across the stern of a boat deck includes a hatch assembly on the deck with at least one removable portion that mates with the hatch assembly, the removable portion capable of removal to provide access to an entryway to a deck of the boat.

In another aspect, a boat includes a hull, a bow, a stern, a deck on the hull, and a seating area extending across the stern. The seating area includes at least one removable section wherein removal of the removable section creates an entryway onto the deck through the stern.

The foregoing and other features, and advantages of the invention as well as embodiments thereof will become more apparent from the reading of the following description in connection with the accompanying drawings.

DESCRIPTION OF THE DRAWINGS

In the accompanying drawings which form part of the specification.

Corresponding reference numerals indicate corresponding parts throughout the several figures of the drawings.

DETAILED DESCRIPTION

Figure 1:
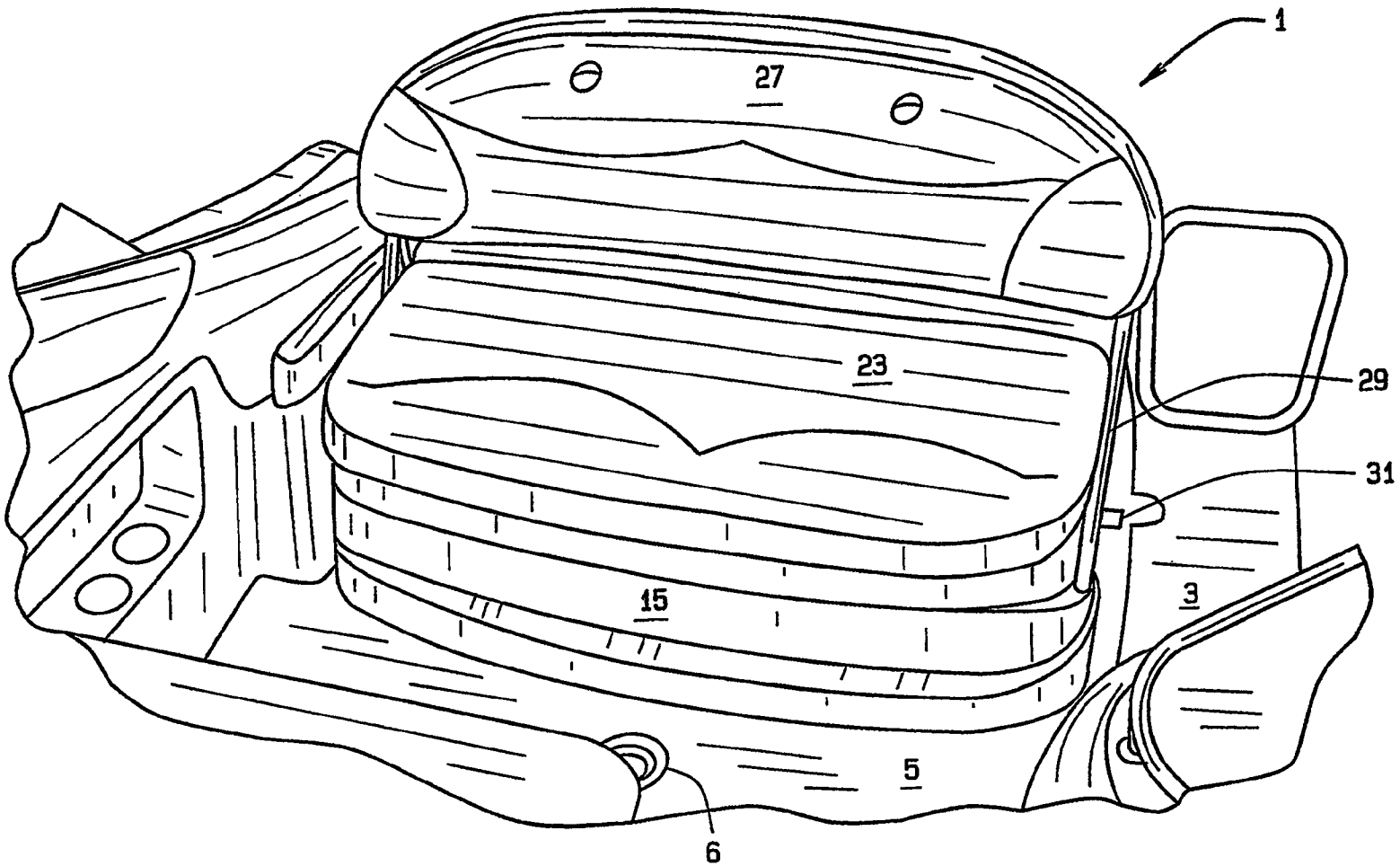
FIG. 1 is a perspective view of a boat with a hatch assembly in accordance with and embodying the present invention.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

As shown in FIGS. 1-6, a first embodiment of the present invention, referred to generally as hatch assembly 1 is similar to the one disclosed in U.S. patent application Ser. No. 11/028,807 filed on Jan. 4, 2005, titled "Hatch Assembly with Seat and Storage Bin". The hatch assembly 1 includes a base 5 pivotally attached to a boat deck 3 with hinges 7 to provide access to an inboard motor mounted within the boat hull at the stern of the boat. As shown in FIG. 5, the base 5 is generally rectangular shaped to correspond with the shape of an opening 8 defined by the deck 3. A recessed edge 9 along the opening 8 seats with the base 5 and defines a channel 6 that works as a drip rail to prevent water from dripping into the hull. Recessed edge 9 collects water and routes or directs water away from the opening. The rear portion of the base 5 includes a step up section 10 (FIG. 5D), which corresponds to a step up area in the boat deck 3. The base 5 includes a storage bin 15 positioned on the top surface of the base 5, the bin 15 defining a compartment C for secure storage.

An electric lift 13 is operatively connected between the base 5 and a power source 11, such as an inboard motor or a battery. In operation, the electric lift 13 extends and retracts to pivot the base 5 between an open and closed position. In the open position, the electric lift 13 extends, thereby pivoting the hatch assembly 1 upwards and providing access to the power source 11 within the boat hull. In the closed position, the electric lift retracts, thereby, pivoting the hatch assembly downwards seating the base 5 on the recessed edge 9 so that the base 5 is flush with the deck 3. For ease of use, the electric lift 13 is also operatively connected to a switch on an instrument panel to allow the operator to remotely open and close the hatch 1. In addition, the lift 13 can be powered independently of the power source 11. Those skilled in the art will recognize that other types of lifts can be used, such as a hydraulic lift, a jack-type lift, or telescoping lift which may function manually and not connected to a power source. In any event, the term lift, particularly in the appended claims, is intended to include any apparatus that functions to raise and lower the hatch assembly 1.

Figure 7:
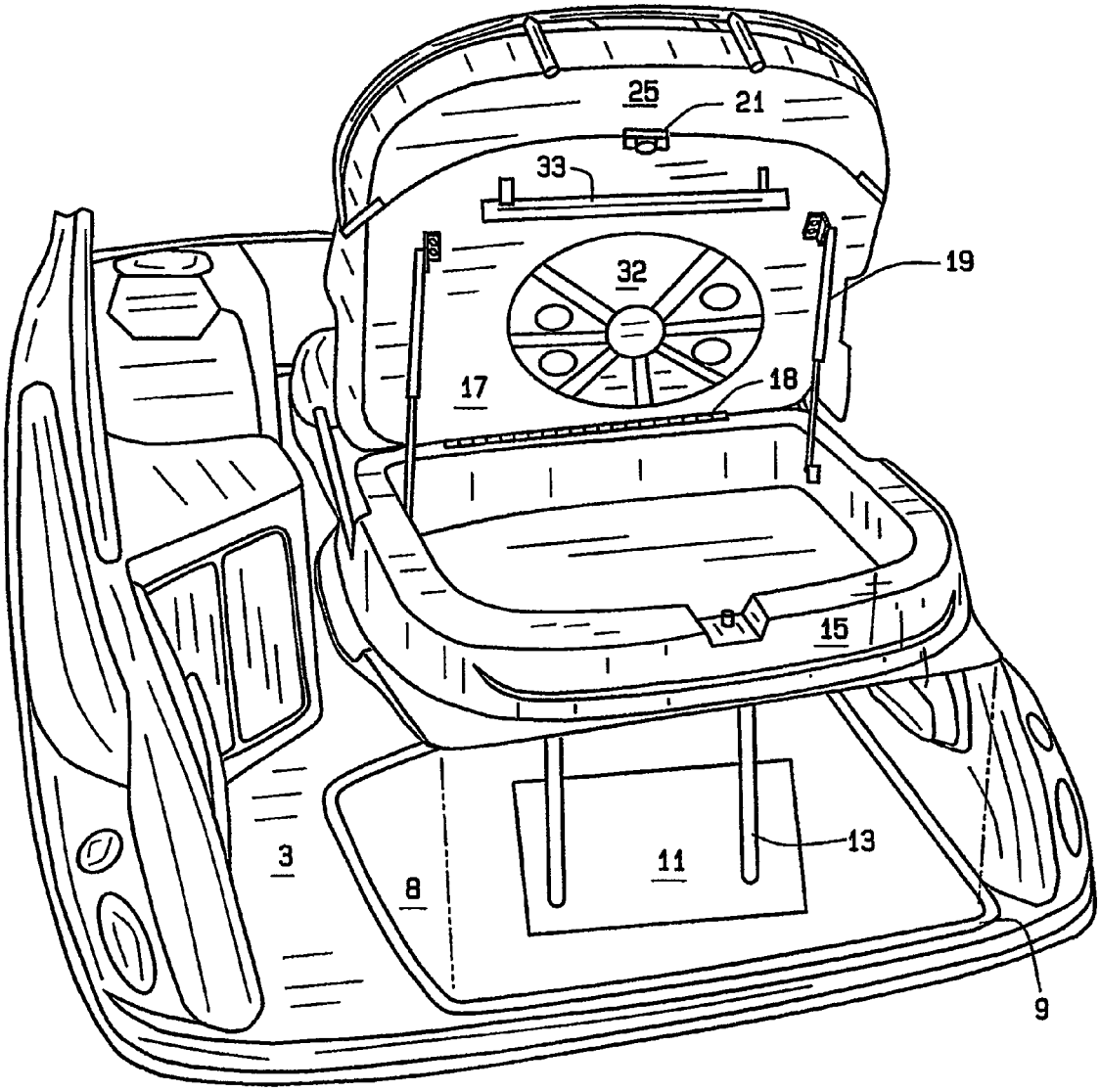
FIG. 7 is a perspective view of an alternate embodiment of a boat with a hatch assembly in accordance with and embodying the present invention.
Figure 8:
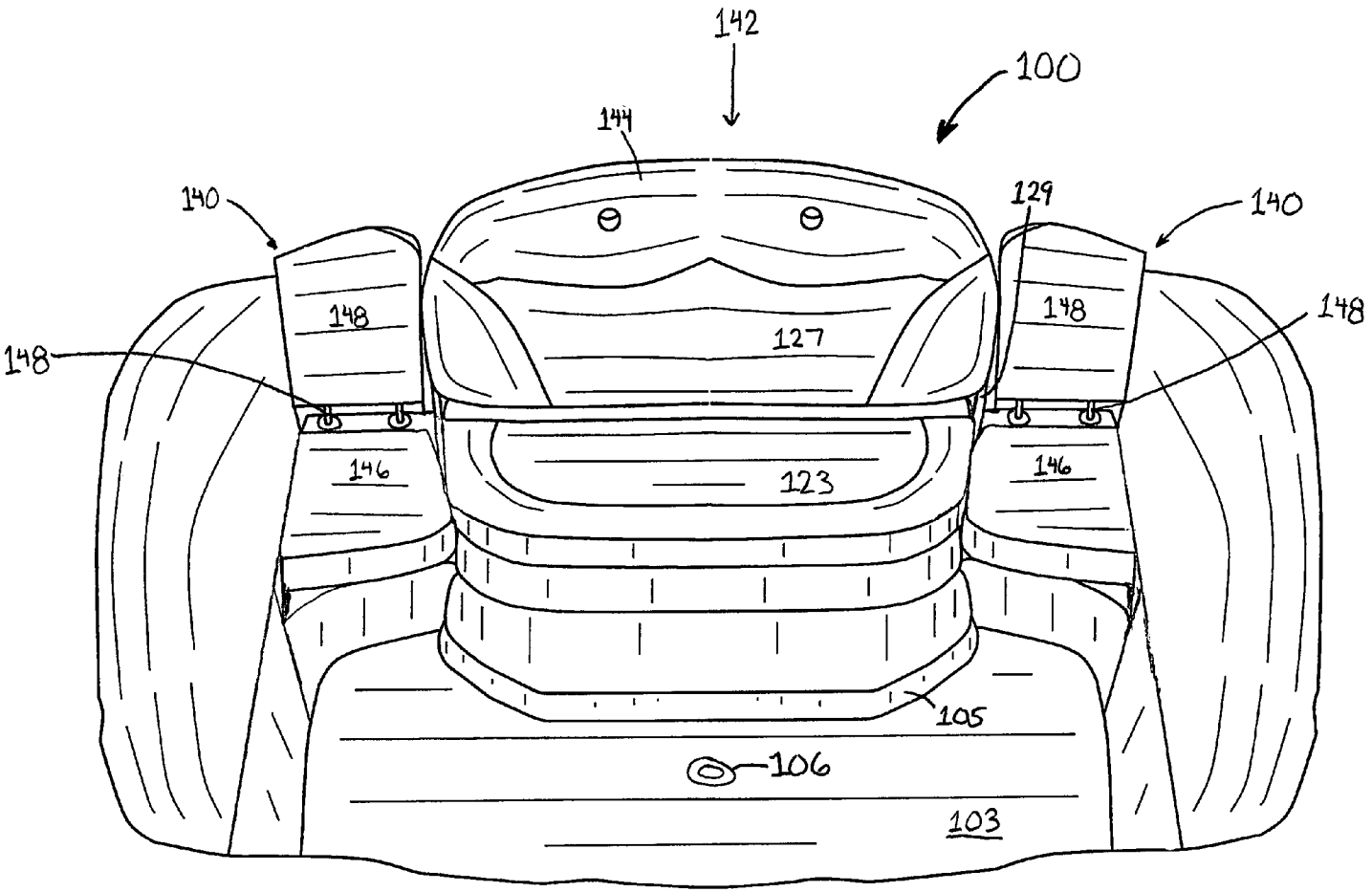
FIG. 8 is a perspective view of a boat with a hatch assembly and removable seats in accordance with and embodying the present invention.
Figure 9:
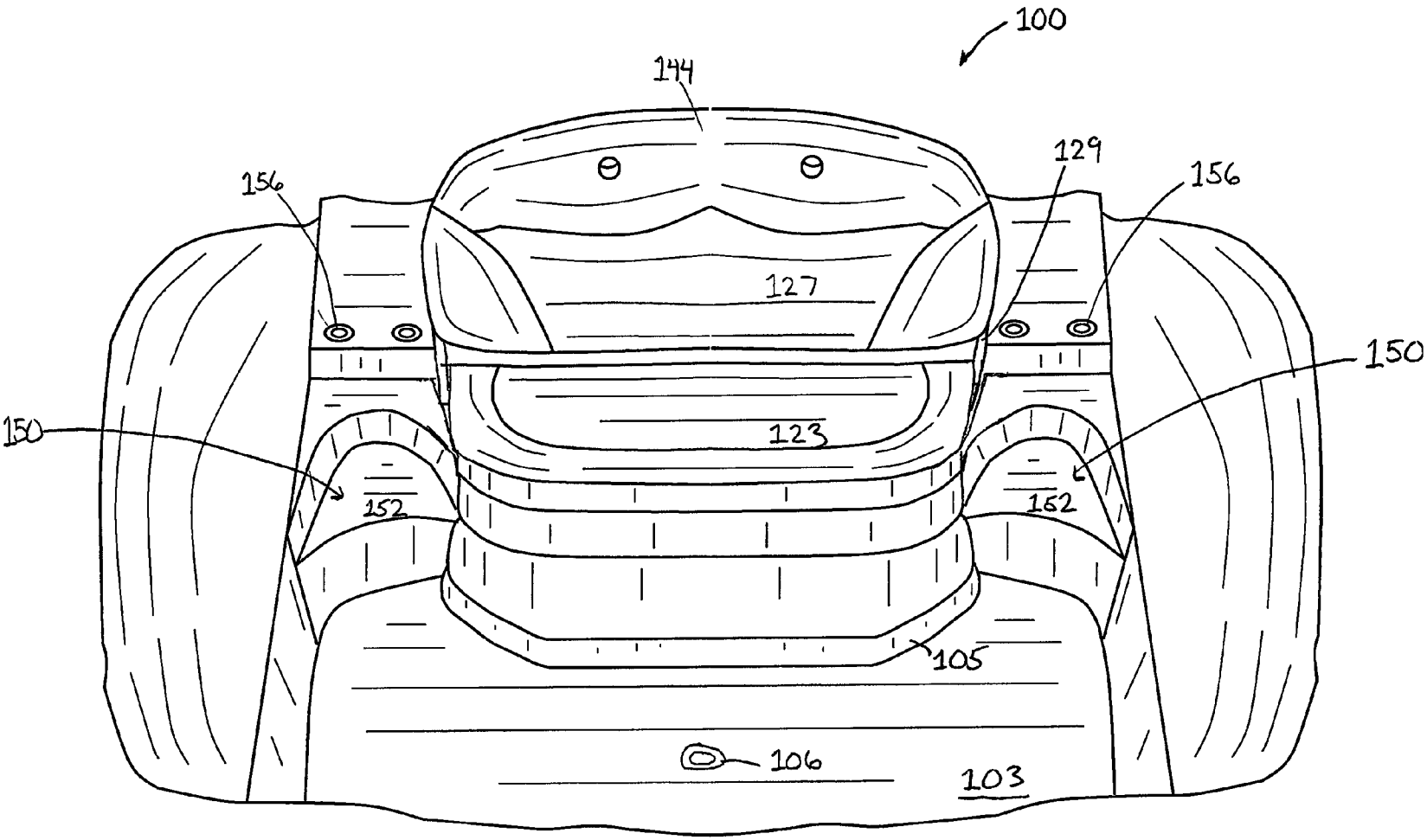
FIG. 9 is a perspective view of the boat with the hatch assembly and with seats removed.

While the first embodiment discloses the base 5 as pivotally attached to the boat deck 3 with hinges 7, alternate embodiments can include other methods of attaching the base 5 to the deck 3. In one alternate embodiment shown in FIG. 7, the base 5 can be removably attached to the deck 3. In this alternate embodiment, the base 5 seats in the recessed edge 9 of the deck opening 8 and can be raised and lowered, either manually or with an appropriate lift 13, from an open position to a closed position.

A lid 17 is pivotally attached to the storage bin 15 with hinge 18. Hydraulic struts 19 operatively connect the lid 17 with the storage bin 15 so that the lid pivots between an open position and a closed position. In the open position, the struts 19 extend, thereby pivoting the lid 17 upwards and providing access to the storage bin 15. The struts 19 are biased to hold the lid 17 in an open position. In the closed position, the struts retract, thereby pivoting the lid 17 downwards seating the lid 17 on the storage bin 15. For security purposes, the lid 17 includes a latch 21 to secure the lid 17 to the storage bin 15. While the illustrated embodiment shows hydraulic struts 19, it is understood that any other apparatus that can be employed to connect the lid with the storage bin so that the lid pivots between an open and closed position is encompassed by the scope of the invention. These apparatus could include, but are not limited to, hinge assemblies, a power actuated lift, a telescoping rod, and so forth. Hence, the term strut is intended to include any such apparatus that can perform the intended function.

While the illustrated embodiment discloses the lid 17 as pivotally attached to the storage bin 15 with hinge 18, alternate embodiments can include other methods of attaching the lid 17 to the storage bin 15. For example, the lid 17 can be removably attached to the storage bin 15.

A front seat 23 and rear seat 25 are mounted to an outer surface of the lid 17 for passenger seating. The base 5 provides structural support to both seats 23 and 25 to handle the weight of the passengers. If desired, the lid 17 can be reinforced to support the weight of the passengers independently of the base. While the illustrated embodiment discloses two seats 23 and 25 mounted to the lid 17, those skilled in the art will recognize that any number of seats can be used, including one or more.

Figure 2:
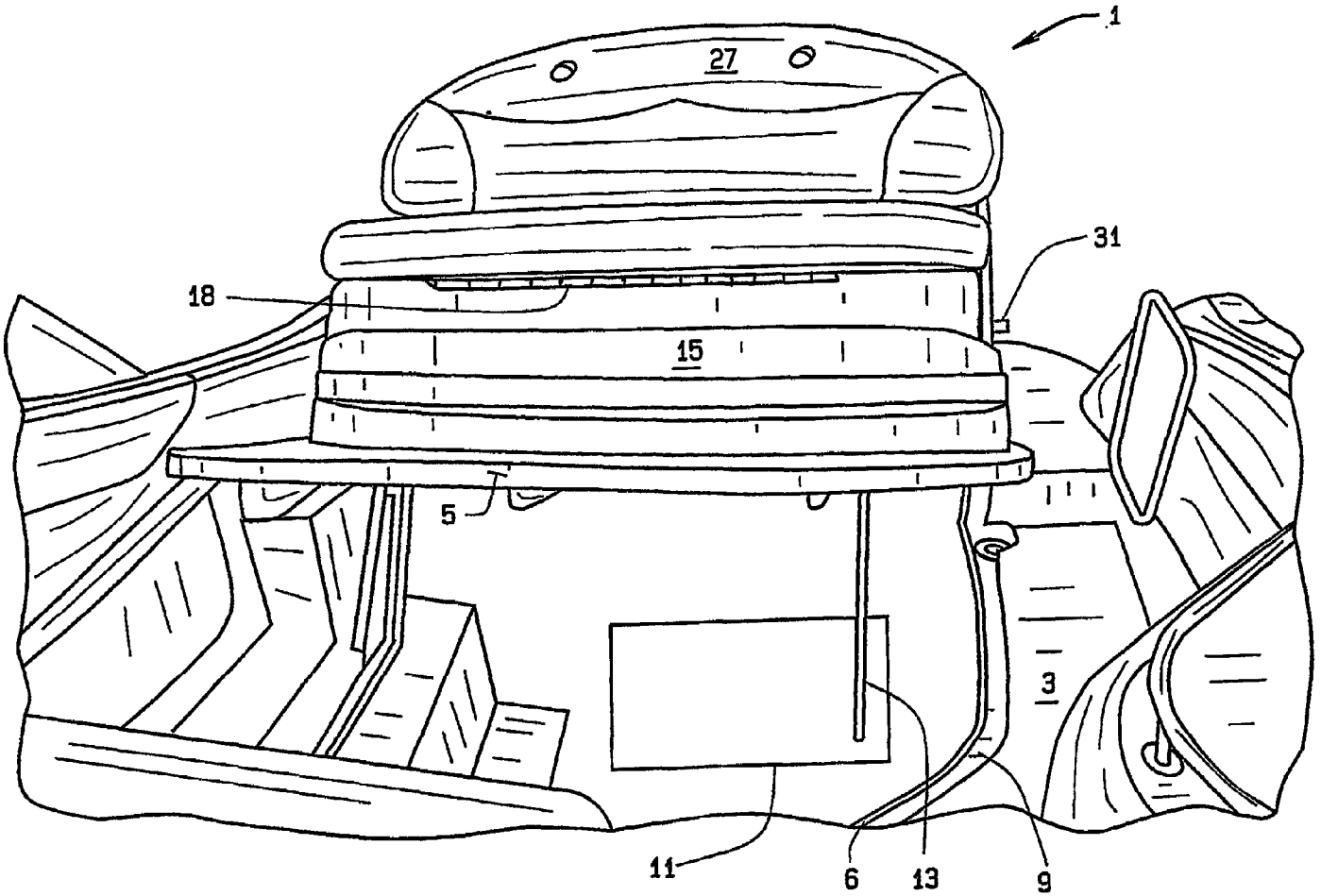
FIG. 2 is a perspective view of the boat with hatch assembly with the hatch assembly in an open position.
Figure 3:
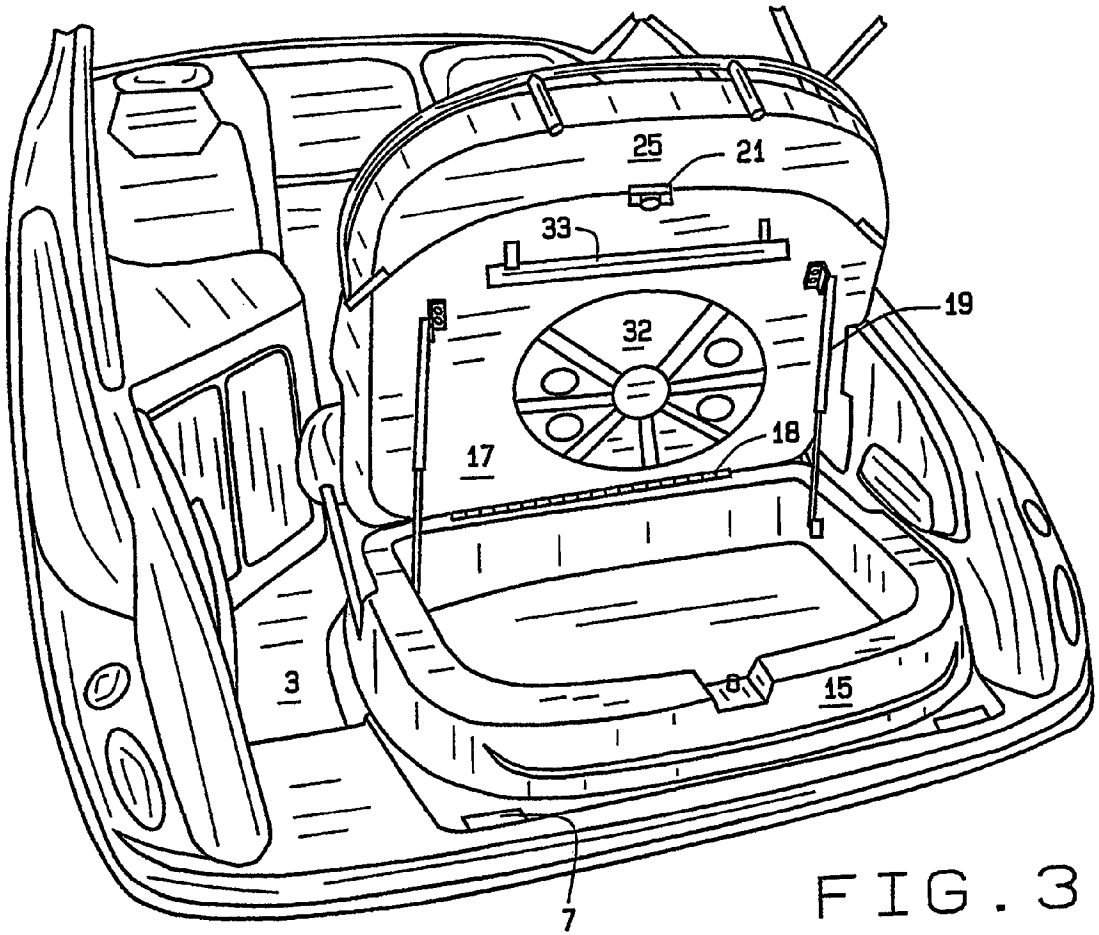
FIG. 3 is a perspective view of the boat with hatch assembly with the storage bin in an open position.
Figure 4:
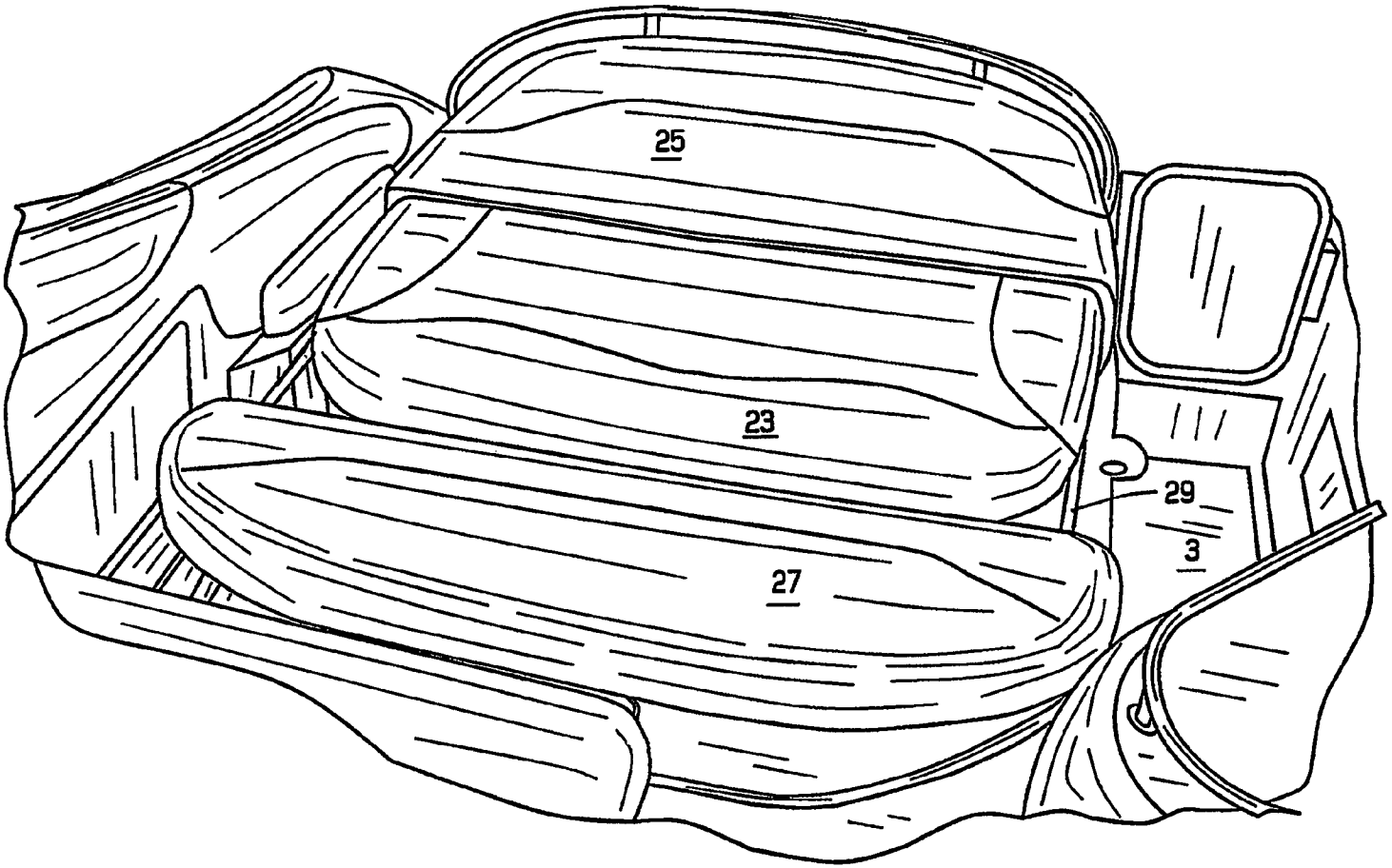
FIG. 4 is a perspective view of the boat with hatch assembly with the backrest in the reclining position.
Figure 5A:
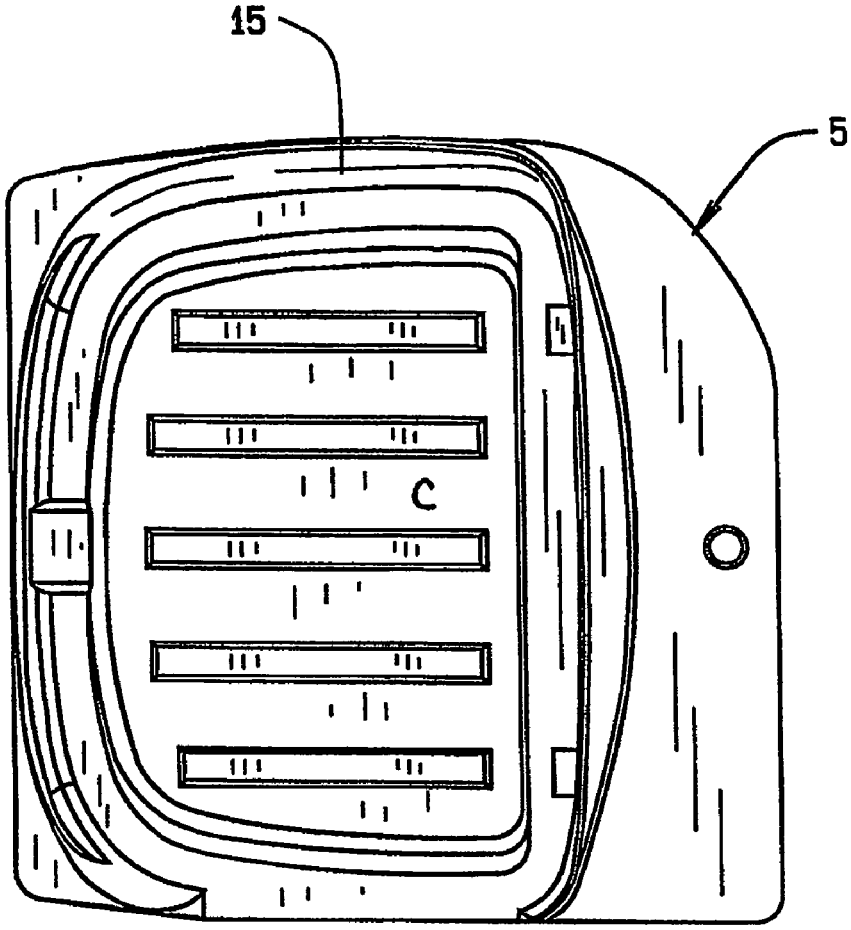
FIG. 5A is a top view of a base.
Figure 5B:
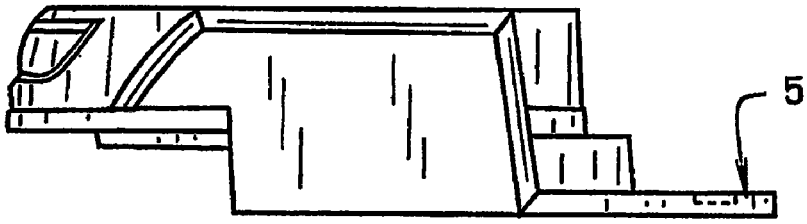
FIG. 5B is a side view of the base.
Figure 5C:
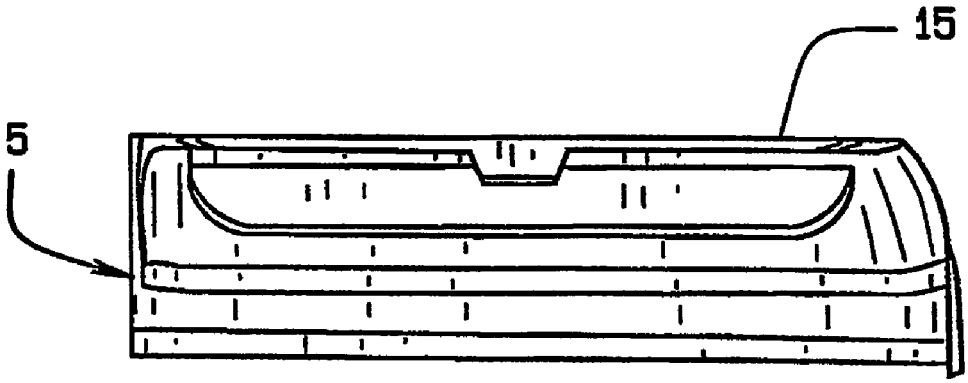
FIG. 5C is a rear view of the base.
Figure 5D:
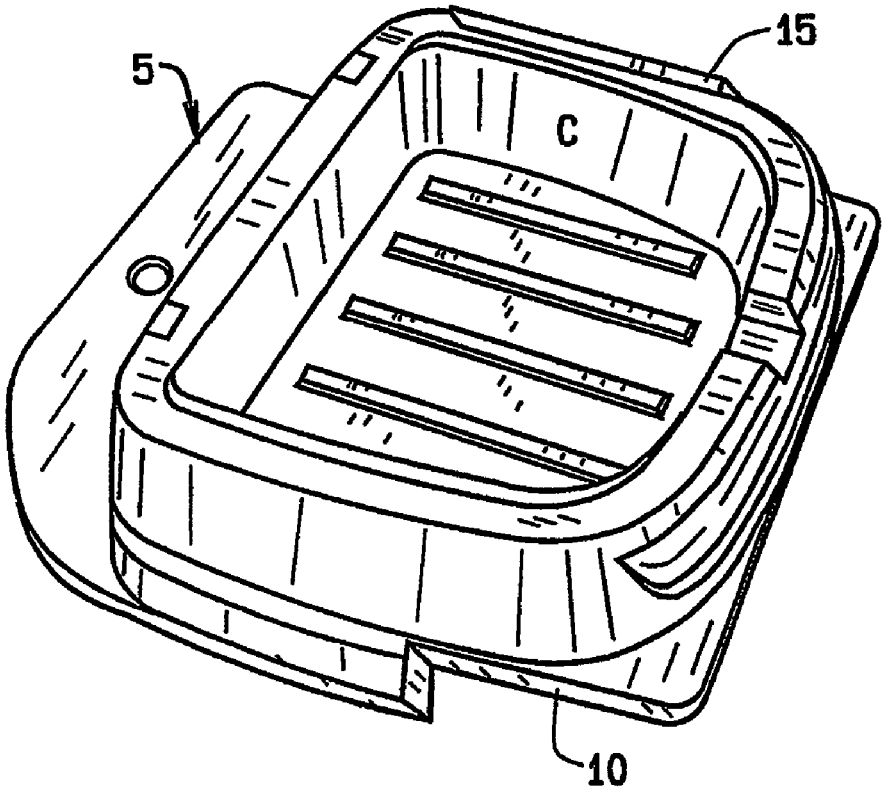
FIG. 5D is a perspective view of the base.
Figure 6:
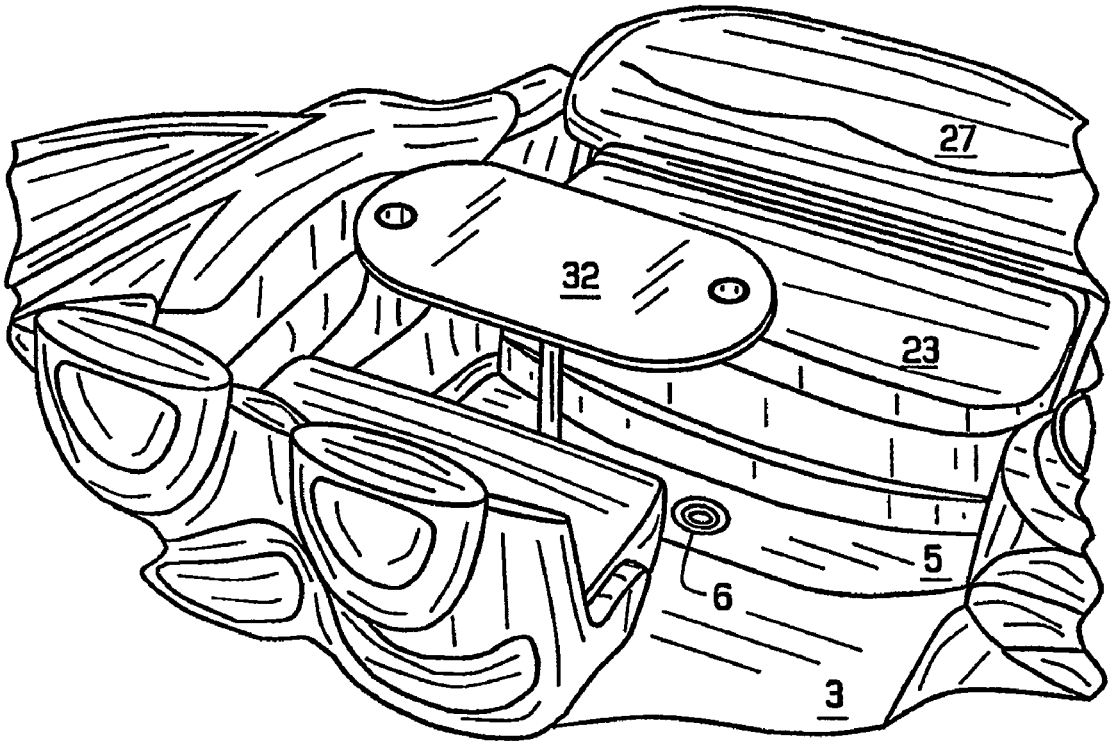
FIG. 6 is a perspective view of the boat with hatch assembly with a table and pedestal installed in the deck.

As best seen in FIGS. 1 and 2, for additional comfort, a padded backrest 27 is pivotally attached to the base 5 by supports 29. The backrest 27 pivots between a sitting position and a reclining position. In the sitting position illustrated in FIG. 1, the backrest 27 is vertically positioned above and juxtaposed between the seats 23 and 25, thereby creating a comfortable backrest for both seat 23 and 25. In the reclining position illustrated in FIG. 4, the backrest 27 is horizontally positioned in front of and parallel with the seats 23 and 25. In this position, the backrest 27 acts as an extension of the seats 23 and 25, thereby providing a large flat padded area that can be used for reclining or as a sun deck. The backrest 27 is secured in each one of these positions with any suitable means, such as a pin 31.

While the illustrated embodiment discloses the backrest 27 as pivotally attached to the base 5 with supports 29, alternate embodiments can include other methods of attaching the backrest 27 to the base 5. For example, the backrest 27 can be removably attached to the base 5.

As an added feature, a table 32 and a pedestal 33 removably attached to an inner surface of the lid 17. The table 32 and pedestal can be removed to be assembled and installed in the boat deck 3 or the base 5. Those skilled in the art will recognize that other accessories can be removably attached to the lid 17, such as fenders, shore power, a light pole, a boat hook or other miscellaneous equipment used in boating.

As shown in FIGS. 8-11, a second embodiment of the present invention, referred to generally as hatch assembly 100, is generally similar to the hatch assembly 1 described above. For ease of understanding, components common between the first and second embodiments are identified with similar reference numbers, except the reference numbers in the second embodiment include a "100" prefix. For example, the base of the first embodiment is identified as 5, while a second embodiment with a similar base device is identified as 105. Naturally, any new components are identified with unique reference numbers.

In the second embodiment, the hatch assembly 100 includes removable seats 140 that form a contiguous seating area 142 when assembled. The hatch assembly 100 forms a main seating portion 144, which is positioned approximately in the center of the stern of the deck 103. Each removable seat 140 includes a seat member 146 and backrest 148 that removably attach to the deck 103 and mate with the main seating portion 144 of the hatch assembly 100. A shown in FIG. 12, one or both of the removable seats 140 can be removed to provide access to one or both entryways 150 to the deck 103 of the boat.

Each seat member 146 is an arcuately shaped cushion that seats within a corresponding recess 152 within the deck 103 with any appropriate means, such as a friction fit. Alternate embodiments of the seat member 146 can include securing means, such as Velcro, to further secure the seat member 146 within the recess 152.

The backrest 148 is an arcuately shaped cushion having brackets 154 extending from the bottom of the backrest 148. The brackets 148 insert into holes 156 of the deck 103. The brackets 148 include an engagement means, such as snap buttons, that provide positive engagement with holes 156 to secure the backrest 148. Those skilled in the art will recognize that any type of bracket can be used, such as the detachable backrest brackets manufactured by GG Schmiff & Sons.

When assembled, the seat member 146 and backrest 148 are aligned with a corresponding front seat 123 and backrest 127 of the main seating area 142 to form a contiguous seating area 142.

The hatch assembly 100 includes a base 105 pivotally attached to a boat deck 103 with hinges 107 to provide access to an inboard motor mounted within the boat hull at the stern of the boat. The base 105 is generally rectangular shaped to correspond with the shape of an opening 108 defined by the deck 103. A recessed edge 109 along the opening 108 seats with the base 105 and defines a channel 106 that works as a drip rail to prevent water from dripping into the hull. Recessed edge 109 collects water and routes or directs water away from the opening. The base 105 includes a storage bin 115 positioned on the top surface of the base 105, the bin 115 defining a compartment C for secure storage.

Figure 10:
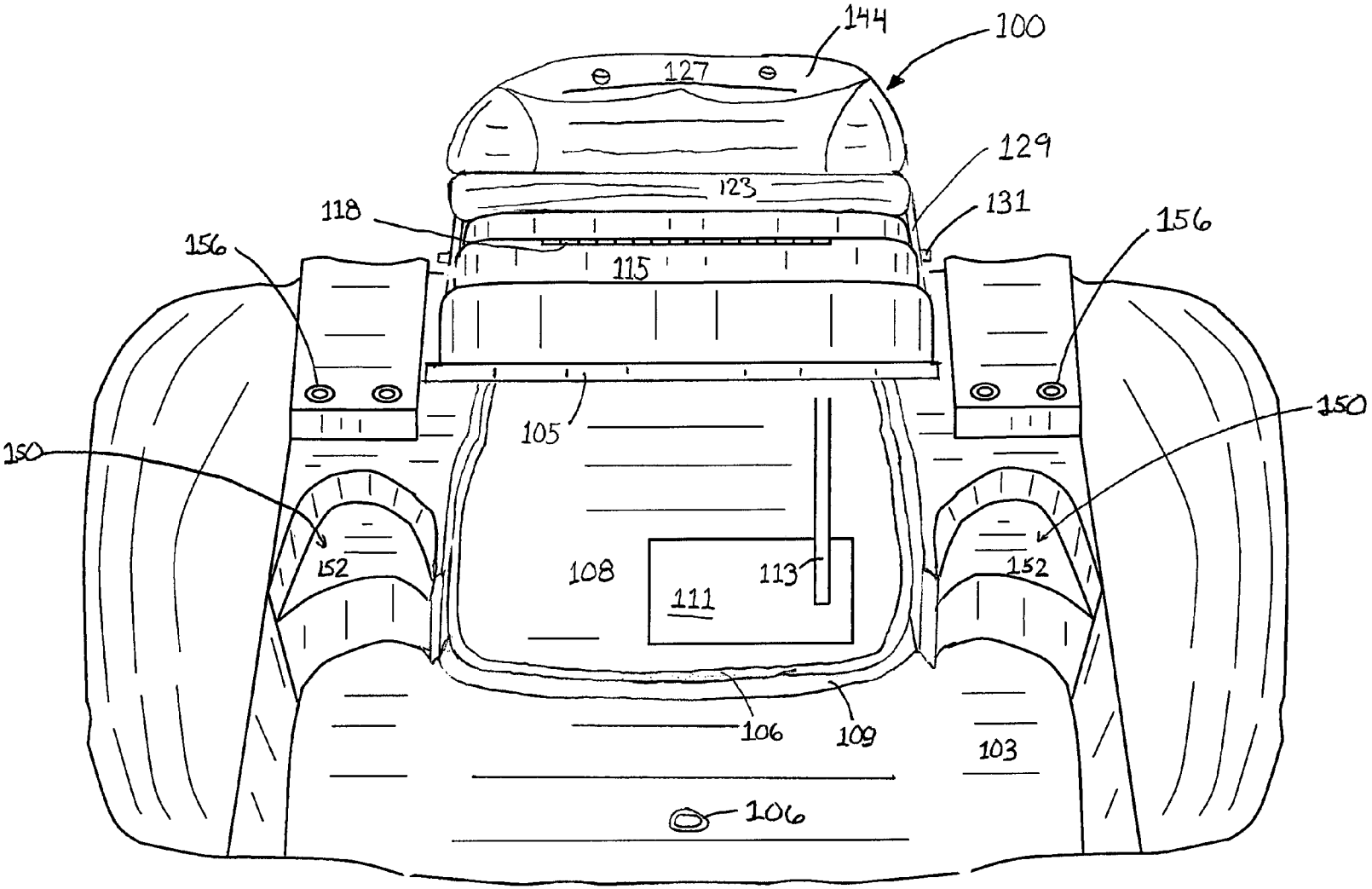
FIG. 10 is a perspective view of the boat with the hatch assembly in an open position and with the seats removed with the storage bin in an open position.

As shown in FIG. 10, an electric lift 113 is operatively connected between the base 105 and a power source 111, such as an inboard motor or a battery. In operation, the electric lift 113 extends and retracts to pivot the base 105 between an open and closed position. In the open position, the electric lift 113 extends, thereby pivoting the hatch assembly 100 upwards and providing access to the power source 111 within the boat hull. In the closed position, the electric lift retracts, thereby, pivoting the hatch assembly downwards seating the base 105 on the recessed edge 109 so that the base 105 is flush with the deck 103. For ease of use, the electric lift 113 is also operatively connected to a switch on an instrument panel to allow the operator to remotely open and close the hatch 100. In addition, the lift 113 can be powered independently of the power source 11. Those skilled in the art will recognize that other types of lifts can be used, such as a hydraulic lift, a jack-type lift, or telescoping lift which may function manually and not connected to a power source. In any event, the term lift, particularly in the appended claims, is intended to include any apparatus that functions to raise and lower the hatch assembly 100.

Figure 11:
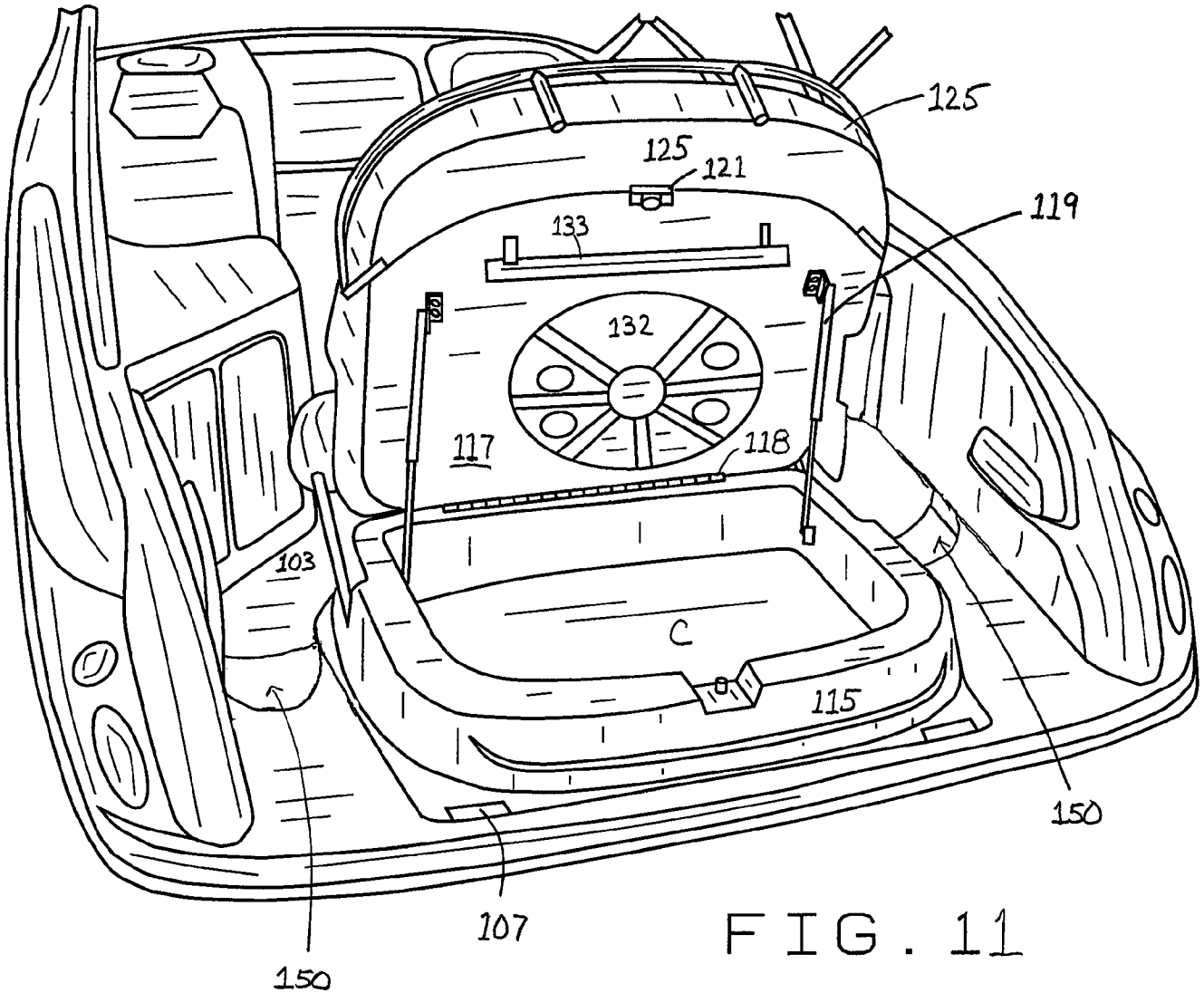
FIG. 11 is a perspective view of the boat of the hatch assembly with the seats removed and with the storage bin in an open position.

As shown in FIG. 11, a lid 117 is pivotally attached to the storage bin 115 with hinge 18. Hydraulic struts 119 operatively connect the lid 117 with the storage bin 115 so that the lid pivots between an open position and a closed position. In the open position, the struts 119 extend, thereby pivoting the lid 117 upwards and providing access to the storage bin 115. The struts 119 are biased to hold the lid 117 in an open position. In the closed position, the struts retract, thereby pivoting the lid 117 downwards seating the lid 117 on the storage bin 115. For security purposes, the lid 117 includes a latch 121 to secure the lid 117 to the storage bin 115. While the illustrated embodiment shows hydraulic struts 119, it is understood that any other apparatus that can be employed to connect the lid with the storage bin so that the lid pivots between an open and closed position is encompassed by the scope of the invention. These apparatus could include, but are not limited to, hinge assemblies, a power actuated lift, a telescoping rod, and so forth. Hence, the term strut is intended to include any such apparatus that can perform the intended function.

While the illustrated embodiment discloses the lid 117 as pivotally attached to the storage bin 115 with hinge 118, alternate embodiments can include other methods of attaching the lid 117 to the storage bin 115. For example, the lid 117 can be removably attached to the storage bin 115.

The front seat 123 and a rear seat 125 are mounted to an outer surface of the lid 117 for passenger seating. The base 105 provides structural support to both seats 123 and 125 to handle the weight of the passengers. If desired, the lid 117 can be reinforced to support the weight of the passengers independently of the base. While the illustrated embodiment discloses two seats 123 and 125 mounted to the lid 117, those skilled in the art will recognize that any number of seats can be used, including one or more.

For additional comfort, the padded backrest 127 is pivotally attached to the base 105 by supports 129. The backrest 127 pivots between a sitting position and a reclining position. In the sitting position illustrated in FIG. 8, the backrest 127 is vertically positioned above and juxtaposed between the seats 123 and 125, thereby creating a comfortable backrest for both seat 123 and 125. In the reclining position, the backrest 127 is horizontally positioned in front of and parallel with the seats 123 and 125. In this position, the backrest 127 acts as an extension of the seats 123 and 125, thereby providing a large flat padded area that can be used for reclining or as a sun deck. The backrest 127 is secured in each one of these positions with any suitable means, such as a pin 131.

While the illustrated embodiment discloses the backrest 127 as pivotally attached to the base 105 with supports 129, alternate embodiments can include other methods of attaching the backrest 127 to the base 105. For example, the backrest 127 can be removably attached to the base 105.

As an added feature, a table 132 and a pedestal 133 removably attached to an inner surface of the lid 117. The table 132 and pedestal can be removed to be assembled and installed in the boat deck 103 or the base 105. Those skilled in the art will recognize that other accessories can be removably attached to the lid 117, such as fenders, shore power, a light pole, a boat hook or other miscellaneous equipment used in boating.

Changes can be made in the above constructions without departing from the scope of the invention, it is intended that all matter contained in the above description or shown in the accompanying drawings shall be interpreted as illustrative and not in a limiting sense.

What is claimed is:

1. A boat comprising:

a hull a bow and a stern:

a deck on the hull having at least one entryway:

a contiguous seating area across the stern of the boat, wherein the contiguous seating area includes a main portion and at least one removable portion that can be removed to provide access to the at least one entryway to the deck of the boat.

2. The boat of claim 1 wherein the removable portion comprises:

a back rest that removably attaches to the deck and mates with the main portion of the contiguous seating area;

a seat member that removably attaches to the deck and mates with the back rest and the main portion of the contiguous seating area.

3. The boat of claim 1 wherein the contiguous seating includes a hatch assembly on the deck, the hatch assembly comprising:

a base pivotally attached to the deck, whereby the base can pivot between an open position and closed position to provide access to a boat hull, wherein the base defines a storage bin;

a lid pivotally attached to the base, whereby the lid can pivot between an open position and a closed position to provide access to the storage bin;

at least one seat attached to the lid forming a portion of the contiguous seating area.

4. The boat of claim 3, wherein the hatch assembly further comprises a lift operatively connected between a power source and the base, whereby the lift pivots the hatch assembly between an open position and closed position.

5. The boat of claim 1 wherein the contiguous seating includes a hatch assembly on the deck, the hatch assembly comprising:

a storage means pivotally attached to the deck, whereby the storage means pivots between an open position and closed position to provide access to a boat hull; and a seating means pivotally attached to the storage means, whereby the seating means pivots from an open position to a closed position to provide access to the storage means.

6. A contiguous seating area across the stern of a boat deck comprising:

a hull;

a bow and a stern:

a deck on the hull having at least one entryway:

a hatch assembly on the deck;

at least one removable portion that mates with the hatch assembly, the removable portion capable of removal to provide access to the entryway to the deck of the boat.

7. The contiguous seating area of claim 6, wherein the removable portion comprises:

a back rest that removably attaches to the deck and mates with the main portion of the contiguous seating area;

a seat member that removably attaches to the deck and mates with the back rest and the main portion of the contiguous seating area.

8. The contiguous seating area of claim 6, wherein the hatch assembly comprises:

a base pivotally attached to the deck, whereby the base can pivot between an open position and closed position to provide access to a boat hull, wherein the base defines a storage bin;

a lid pivotally attached to the base, whereby the lid can pivot between an open position and a closed position to provide access to the storage bin; and at least one seat attached to the lid forming a portion of the contiguous seating area.

9. The contiguous seating area of claim 8, wherein the hatch assembly further comprises a lift operatively connected between a power source and the base, whereby the lift pivots the hatch assembly between an open position and closed position.

10. The contiguous seating area of claim 6, the hatch assembly comprising:

a storage means pivotally attached to the deck, whereby the storage means pivots between an open position and closed position to provide access to a boat hull; and a seating means pivotally attached to the storage means, whereby the seating means pivots from an open position to a closed position to provide access to the storage means.

11. A boat comprising:

a hull;

a bow and a stern;

a deck on the hull;

a seating area extending across the stern, the seating area including at least one removable section wherein removal of the removable section creates an entryway onto the deck through the stern.

12. The boat of claim 11 wherein the removable section comprises:

a back rest that removably attaches to the deck and mates with a main portion of the seating area;

a seat member that removably attaches to the deck and mates with the back rest and the main portion of the seating area.

13. The boat of claim 11 wherein the seating includes a hatch assembly on the deck, the hatch assembly comprising:

a base pivotally attached to the deck, whereby the base can pivot between an open position and closed position to provide access to a boat hull, wherein the base defines a storage bin;

a lid pivotally attached to the base, whereby the lid can pivot between an open position and a closed position to provide access to the storage bin; and at least one seat attached to the lid forming a portion of the seating area.

14. The boat of claim 13, wherein the hatch assembly further comprises a lift operatively connected between a power source and the base, whereby the lift pivots the hatch assembly between an open position and closed position.

15. The boat of claim 11, wherein the seating includes a hatch assembly on the deck, the hatch assembly comprising:

a storage means pivotally attached to the deck, whereby the storage means pivots between an open position and closed position to provide access to the hull; and a seating means pivotally attached to the storage means, whereby the seating means pivots from an open position to a closed position to provide access to the storage means.

* * * * *